US010176910B2

(12) United States Patent
Xie et al.

(10) Patent No.: US 10,176,910 B2
(45) Date of Patent: Jan. 8, 2019

(54) NON-ORIENTED SILICON STEEL AND MANUFACTURING PROCESS THEREOF

(71) Applicant: Baoshan Iron & Steel Co., Ltd., Shanghai (CN)

(72) Inventors: Shishu Xie, Shanghai (CN); Xiandong Liu, Shanghai (CN); Xiao Chen, Shanghai (CN); Hongxu Hei, Shanghai (CN); Bo Wang, Shanghai (CN); Aihua Ma, Shanghai (CN); Liang Zou, Shanghai (CN); Huawei Zhang, Shanghai (CN); Wei Cao, Shanghai (CN); Feng Zhang, Shanghai (CN); Junliang Liu, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 830 days.

(21) Appl. No.: 14/371,028

(22) PCT Filed: Dec. 11, 2012

(86) PCT No.: PCT/CN2012/001685

§ 371 (c)(1),
(2) Date: Jul. 8, 2014

(87) PCT Pub. No.: WO2013/127048

PCT Pub. Date: Sep. 6, 2013

(65) Prior Publication Data

US 2015/0013844 A1 Jan. 15, 2015

(30) Foreign Application Priority Data

Mar. 2, 2012 (CN) ..... 2012 1 0054182

(51) Int. Cl.

| | |
|---|---|
| ***H01F 1/147*** | (2006.01) |
| ***C22C 38/06*** | (2006.01) |
| ***C22C 38/00*** | (2006.01) |
| ***C22C 38/02*** | (2006.01) |
| ***C22C 38/04*** | (2006.01) |
| ***C21D 9/46*** | (2006.01) |
| ***C21D 8/12*** | (2006.01) |
| ***C22C 38/60*** | (2006.01) |
| ***C21C 7/068*** | (2006.01) |
| *C21D 6/00* | (2006.01) |

(52) U.S. Cl.

CPC ..... *H01F 1/14775* (2013.01); *C21C 7/068* (2013.01); *C21D 8/1261* (2013.01); *C21D 8/1272* (2013.01); *C21D 9/46* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/60* (2013.01); *H01F 1/14791* (2013.01); *C21D 6/008* (2013.01); *C21D 8/1233* (2013.01)

(58) Field of Classification Search

CPC .... C21D 6/008; C21D 8/1261; B22D 11/115; H01F 1/14775; H01F 1/14791

USPC ..... 148/111

See application file for complete search history.

(56) References Cited

FOREIGN PATENT DOCUMENTS

| | | | | |
|---|---|---|---|---|
| CN | 1796015 | A | | 7/2006 |
| CN | 101041222 | A | | 9/2007 |
| CN | 101333620 | A | * | 12/2008 |
| CN | 101871035 | A | * | 10/2010 |
| JP | 62-23932 | A | | 1/1987 |
| JP | 01219125 | A | * | 9/1989 |
| KR | 20040041801 | A | * | 5/2004 |
| KR | 20050066235 | A | | 6/2005 |

OTHER PUBLICATIONS

PCT International Preliminary Report on Patentability and Written Opinion for PCT Application No. PCT/CN2012/001685 dated Sep. 2, 2014 (25 pages).

PCT International Search Report for PCT Application No. PCT/CN2012/001685 dated Mar. 21, 2013 (6 pages).

* cited by examiner

*Primary Examiner* — Weiping Zhu

(74) *Attorney, Agent, or Firm* — Eversheds-Sutherland (US) LLP

(57) ABSTRACT

The present invention provides a non-oriented silicon steel with excellent magnetic properties and a manufacturing process therefor. During the manufacturing process of the present invention, the temperature T of the molten steel of steel tapped from a converter during steelmaking and the carbon content [C] and the free oxygen content [O] comply with the following formula: $7.27\times10^3 \leq [O][C]e^{(-5000/T)} \leq 2.99\times10^4$, and the final annealing step uses tension annealing at a low temperature for a short time. A non-oriented silicon steel with a low iron loss, and excellent anisotropy of iron loss can be obtained by means of the manufacturing process of the present invention.

9 Claims, 3 Drawing Sheets

Mn/S

NON-ORIENTED SILICON STEEL AND MANUFACTURING PROCESS THEREOF

CROSS REFERENCE TO RELATED APPLICATIONS

This application claims the priority benefit of PCT/CN2012/001685 filed on Dec. 11, 2012 and Chinese Application No. 201210054182.1 filed on Mar. 2, 2012. The contents of these applications are hereby incorporated by reference in their entirety.

TECHNICAL FIELD

The present invention involves non-oriented silicon steel and its manufacturing method, and specifically non-oriented silicon steel characterized by excellent iron loss and anisotropy of iron loss and its manufacturing method.

BACKGROUND TECHNOLOGY

Non-oriented silicon steel is mainly used to make the stator cores of medium and large-sized motors (>50 HP) and generators, as well as the stator and rotor cores of small-sized motors with high requirements on energy efficiency. In order to miniaturize electronic equipment and conserve energy, it is required that the non-oriented silicon steel used should be of low iron loss and excellent anisotropy of iron loss.

The traditional method for manufacturing the non-oriented silicon steel adopts the casting slab containing silicon (2.5 wt % or more) and aluminum (0.2 wt % or more) to increase the electric resistance of the non-oriented silicon steel, thus reducing its iron loss. However, the method requires a final annealing temperature of 1,000° C. or more, which results in the problems of high cost, nodulation of furnace roller, etc.

In order to manufacture the non-oriented silicon steel which can both miniaturize electronic equipment and conserve energy, many studies have been conducted on the ingredients and manufacturing process of non-oriented silicon steel, with the purpose of developing the non-oriented silicon steel with excellent magnetic properties.

The U.S. Pat. No. 4,560,423 discloses a casting slab containing the following ingredients as calculated by weight percentage: Si≥2.5%, Al≥1.0%, 3.5%≤(Si+Al)≤5.0%, S≤0.005% and N≤0.004%, which goes through the two-stage annealing process, i.e., it is firstly kept thermal insulation at 850~1,000° C. for 30~120 s and then at 1,050° C. for 3~60 s to obtain the non-oriented silicon steel having an iron loss of $P_{15/50}$≤2.70 W/kg (silicon steel of 0.5 mm thickness).

The Japanese published Patent JP1996295936S discloses a casting slab containing the following ingredients as calculated by weight percentage: C<0.005%, Si: 2.0~4.0%, Al: 0.05~2%, Mn: 0.05~1.5%, P≤0.1%, S≤0.003%, N≤0.004%, Sn: 0.003~0.2%, Cu: 0.015~0.2%, Ni: 0.01~0.2%, Cr: 0.02~0.2%, V: 0.0005~0.008% and Nb<0.01%, which goes through the normalizing and cooling process at cooling rate of 80° C./s or less, then the cold rolling process at the reduction rate of 88% or more and finally the two-stage annealing process to obtain the non-oriented silicon steel having low iron loss.

In the U.S. Pat. No. 6,139,650, Sb, Sn and rare earth elements such as Se, Te are added into the casting slab to control the S content, the surface nitrogen content and the like of the silicon steel, and thus to control iron loss $P_{15/50}$ of silicon steel (silicon steel of 0.5 mm thickness) to be 2.40 W/kg or less.

Although all the above prior technologies can control the iron loss of silicon steel at a relatively low level, they have not taken into account the anisotropy of iron loss. It is well known that, the anisotropy of iron loss of silicon steel directly influences the rotational loss of stator and rotor cores and is one key factor determining the excellent loss characteristic of motor-driven equipment. Therefore, development of the non-oriented silicon steel simultaneously having low iron loss and excellent anisotropy of iron loss will present an important significance and broad application prospect.

SUMMARY OF THE INVENTION

The purpose of the present invention is to provide non-oriented silicon steel having excellent magnetic properties and its manufacturing method. In the present invention, the non-oriented silicon steel has a relatively low iron loss (iron loss $P_{15/50}$≤2.40 W/kg for silicon steel of 0.5 mm thickness) and excellent anisotropy of iron loss (≤10%), and can satisfy the requirements of medium and large-sized motors and generators as well as small-sized high-efficiency motors on their core materials. In addition, the method of the present invention is also characterized by low cost, stable effect, etc.

The present invention relates to a method for producing non-oriented silicon steel, comprising the following steps in sequence: a) steel making, b) hot rolling, c) normalizing, d) cold rolling, and e) annealing, wherein, By said steel making step a), a casting slab containing the following composition by weight percentage is obtained: C 0.001~0.004%, Si 2.5~4.0%, Al 0.5~1.5%, Mn 0.10~1.50%, P≤0.02%, S≤0.002%, N≤0.003%, B≤0.005%, where Mn/S≥300, Al/N≥300, and the balance being Fe and unavoidable impurities; wherein, said steel making step a) includes converter steel making, in which temperature T (in K) of molten steel during tapping on converter, the carbon content [C] (in ppm) and the free oxygen content [O] (in ppm) satisfy the following formula:

$$7.27\times10^3 \le [O][C]e^{(-5,000/T)} \le 2.99\times10^4, \text{ and}$$

In said annealing step e), the cold-rolled steel strip is heated to 900~1,050° C., and then is subject to thermal insulation under a tension б of 0.5~1.5 MPa for a period of time t of 8~60 s.

In the method of the present invention, firstly obtaining a casting slab by steel making, and forming a hot-rolled steel strip by hot rolling the casting slab, then making a normalizing treatment for the hot-rolled steel strip, and forming cold-rolled steel strip by cold rolling the hot-rolled steel strip after normalizing treatment, and finally making a final annealing treatment for the cold-rolled steel strip.

In the method of the present invention, in view of reducing the manufacturing cost and improving the quality stability of silicon steel products, the period of time t in said annealing step e) should be limited to 8~60 s. When the period of time t is shorter than 8 s, the grains are not adequately coarsened, which goes against the reduction of the iron loss and the anisotropy of iron loss of the non-oriented silicon steel; when the period of time t exceeds 60 s, the manufacturing cost is elevated, and both the iron loss and the anisotropy of iron loss of the non-oriented silicon steel fail to be further improved.

In the method of the present invention, the unavoidable impurities contained in said casting slab preferably are: Nb≤0.002 wt %, V≤0.003 wt %, Ti≤0.003 wt %, and Zr≤0.003 wt %.

In the method of the present invention, in view of promoting the growth of grains and reducing their property difference between rolling direction and cross direction, the temperature of said annealing step e) is preferably controlled between 900 and 1,050° C., and further preferably controlled between 920 and 1,000° C.; the tension б of said annealing step e) is preferably controlled between 0.5 and 1.5 MPa, and further preferably controlled between 1 and 1.3 MPa. If the temperature of said annealing step e) is too low, it will hinder the growth of grains; if the temperature of said annealing step e) is too high, it will go against the purposes of reducing the manufacturing cost and simplifying the technical process. If the tension б of said annealing step e) is too low, it will go against the rapid growth of grains in short-term annealing at a low temperature; if the tension б of said annealing step e) is too high, the property difference of grains between rolling direction and cross direction will be significant, which goes against the reduction of the anisotropy of iron loss of the non-oriented silicon steel.

In the method of the present invention, in view of further reducing the content of N and O in the surface layer of the final silicon steel products and improving the crystal texture of the silicon steel products, the casting slab in said steel making step a) preferably also contains Sn and/or Sb, wherein the content of Sb+2Sn ranges between 0.001~0.05 wt %.

In the method of the present invention, said steel making step a) further includes step of RH refining, and, in view of the improvement of deoxidation effect, in RH refining, preferably a deoxidation is implemented at the end of decarbonization first by using FeSi alloy and then by using FeAl alloy.

In the method of the present invention, said normalizing step c) may adopt a batch furnace of normalization or a continuous annealing of normalization. For the purposes of further reducing the anisotropy of iron loss, obtaining best sheet shape and making it easy for cold rolling, preferably the batch furnace of normalization is adopted under the following conditions: under a protection atmosphere of nitrogen and hydrogen, the steel strip subject to a thermal insulation at 780~880° C. for 2~6 h; or preferably the continuous annealing of normalization is adopted under the following conditions: the hot-rolled steel strip is firstly heated to 850~950° C. at a heating rate of 5~15° C./s, and is subject to a thermal insulation under a protection atmosphere of nitrogen for a period of time t of 10~90 s, then is cooled to 650° C. at a cooling rate of 10° C./s or less, and is finally left for natural cooling.

In the method of the present invention, for the purpose of further reducing the anisotropy of iron loss, preferably said cold rolling step d) has a reduction rate of 70~88%.

In the method of the present invention, for the purpose of further improving the grain structure of the final silicon steel products, preferably said hot rolling step b) has a deformation of 80% or more at 950° C. or more. In addition, for the purposes of obtaining suitable sheet shape and preventing edge crack, the maximum temperature difference between various positions of the hot-rolled steel strip is preferably controlled to be 20° C. or less, and further preferably 10° C. or less.

In addition to the manufacturing process of non-oriented silicon steel, the present invention also provides non-oriented silicon steel having low iron loss and excellent anisotropy of iron loss which can be made by using the casting slab containing 2.5~4.0 wt % Si according to said manufacturing process in the present invention. In the present invention, the non-oriented silicon steel has a grain diameter between 100 μm and 200 μm, and a grain equivalent axial coefficient L between 1.05 and 1.35.

Furthermore, preferably said casting slab also has a following composition by weight percentage: C 0.001~0.004%, Al 0.5~1.5%, Mn 0.10~1.50%, P≤0.02%, S≤0.002%, N≤0.003%, B≤0.005%, Mn/S≥300, Al/N≥300, and the balance being Fe and unavoidable impurities.

Furthermore, preferably the total content of nitrogen and oxygen at depth of 30 μm from the surface of the non-oriented silicon steel in the present invention is 300 ppm or less.

Furthermore, preferably the amount of inclusions having a size of 500 nm or less contained in the non-oriented silicon steel in the present invention is 40% or less.

In the present invention, by strictly controlling the relationship between the temperature T of molten steel during tapping on converter and the carbon content [C] and free oxygen content [O] and regulating the content of various ingredients in the casting slab, the amount of inclusions can be reduced and their form can be controlled, so as to improve the structure and magnetic properties of the non-oriented silicon steel.

Furthermore, in said annealing step e), by applying an appropriate tension and providing short-term annealing at a suitable temperature, the grains can rapidly grow, and their property difference between rolling direction and cross direction will be small, which contributes to the reduction of both the iron loss and the anisotropy of iron loss.

By means of regulating the content of various ingredients in the casting slab through steel making, strictly controlling the relationship between the temperature T of molten steel during tapping on converter and the carbon content [C] and free oxygen content [O] to reduce the amount of inclusions and control their form, and applying an appropriate tension and providing short-term annealing at a low temperature to control the form of grains, the present invention can obtain non-oriented silicon steel having excellent iron loss and anisotropy of iron loss. In the present invention, the non-oriented silicon steel has an iron loss of $P_{15/50}$≤2.40 W/kg (for silicon steel of 0.5 mm thickness) and anisotropy of iron loss of 10% or less, wherein $P_{15/50}$ represents the iron loss of the non-oriented silicon steel under a magnetic induction of 1.5 T at 50 Hz.

DETAILED DESCRIPTION OF THE INVENTION

Firstly, the reasons for limiting various ingredients contained in the casting slab for manufacturing the non-oriented silicon steel in the present invention are explained as follows.

Si: being soluble in ferrite to form substitutional solid solution, improving resistivity of the substrate and significantly reducing the iron loss and increasing the yield strength, it is one of the most important alloying elements in non-oriented silicon steel. If Si content is too low, its effect of reducing iron loss will become insignificant; if Si content is too high, not only its effect of reducing iron loss obviously decreases, but also it will cause processing difficulty. In the present invention, Si content is limited to 2.5~4.0 wt %.

Al: being soluble in ferrite to improve resistivity of the substrate, coarsen grains, reduce iron loss and improve yield strength while deoxidating and fixing nitrogen, but easily causing oxidation inside the surface of finished steel sheet products. If Al content is too low, its effect of reducing iron loss, deoxidating and fixing nitrogen will become insignificant; if Al content is too high, it is difficult to smelt and cast, magnetic induction decreases and process is difficult. In the present invention, Al content is limited to 0.5~1.5 wt %.

Mn: being similar to Si and Al, it also can improve the resistivity of steel and reduce iron loss, bond with the impurity element S to form stable MnS and eliminate the harm of S for magnetic property. In addition to preventing hot shortness, it's also soluble in ferrite to form substitutional solid solution, has a function of strengthening solid solution, and improves the yield strength of the matrix. If Mn content is too low, the above effects will become insignificant; if Mn content is too high, both the phase transformation point temperature Acl and recrystallization temperature of the silicon steel will reduce, and there will be $\alpha$-$\gamma$ phase transformation when heat treatment, thus deteriorate the favorable crystal texture. In the present invention, Mn content is limited to 0.10~1.50 wt %.

Figure 1:
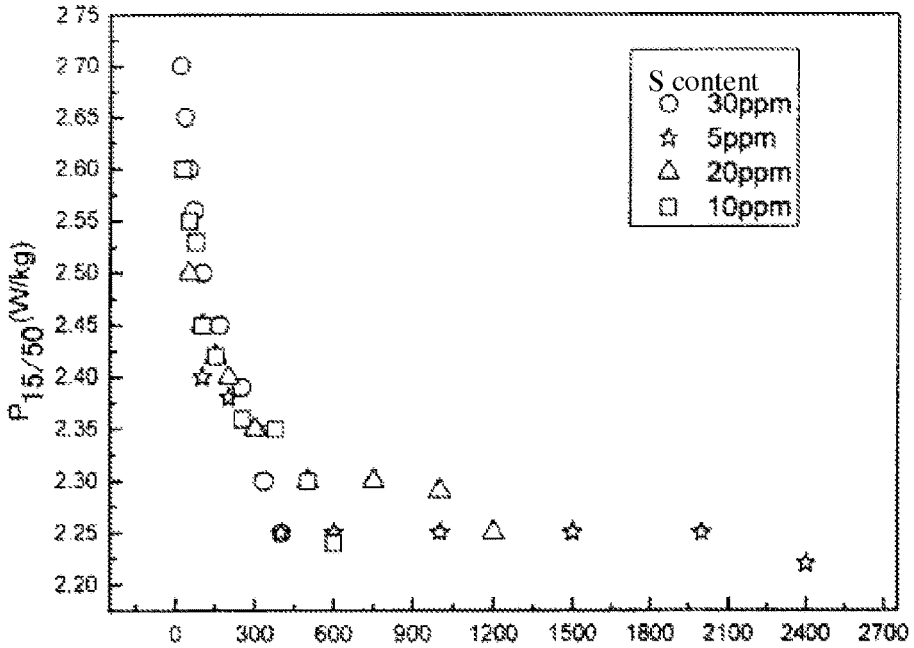
FIG. 1 shows the relationship between the Mn/S ratio of the casting slab for manufacturing the non-oriented silicon steel and the iron loss $P_{15/50}$ of the non-oriented silicon steel.

Furthermore, the present inventor has investigated the relationship between the Mn/S ratio and the iron loss $P_{15/50}$ of the non-oriented silicon steel. FIG. 1 shows the relationship between the Mn/S ratio of the casting slab for manufacturing the non-oriented silicon steel and the iron loss $P_{15/50}$ of the non-oriented silicon steel. As shown in FIG. 1, a good effect of reducing iron loss ($P_{15/50}$) is observed when the Mn/S ratio is 300 or more, and that the effect of reducing iron loss ($P_{15/50}$) becomes basically saturation when the Mn/S ratio reaches 600. In the present invention, the Mn/S ratio is limited 300 or more, and preferably between 350 and 600.

Figure 2:
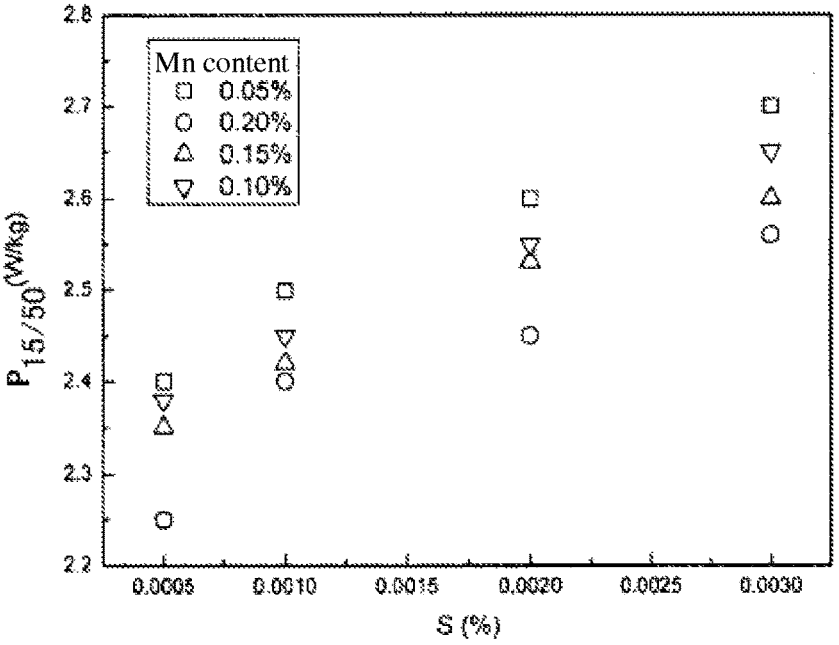
FIG. 2 shows the relationship between the S content of the casting slab for manufacturing the non-oriented silicon steel and the iron loss P15/50 of the non-oriented silicon steel.

S: being harmful for both processability and magnetic property, it is easy to form fine MnS particles together with Mn, hinders the growth of annealed grains of the finished products and severely deteriorates the magnetic property. In addition, it is easy for S to form low-melting-point FeS and $FeS_2$ or eutectic crystal together with Fe and causes the problem of hot processing brittleness. The present inventor has investigated the influence of S content on the iron loss $P_{15/50}$ of the non-oriented silicon steel. FIG. 2 shows the relationship between the S content of the casting slab for manufacturing the non-oriented silicon steel and the iron loss $P_{15/50}$ of the non-oriented silicon steel. As shown in FIG. 2, the iron loss $P_{15/50}$ of the non-oriented silicon steel is deteriorated when S content exceeds 0.002 wt %. In the present invention, S content is limited to be 0.002 wt % or less.

P: adding a certain amount of phosphorus into steel can improve the processability of the steel strip; however, if P content is too high, it will deteriorate the cold rolling processability of steel strip. In the present invention, P content is limited to be 0.02% or less.

C: being harmful for the magnetic property, it is an element which intensively hinders the growth of grains while expanding the $\gamma$ phase zone; an excessive amount of C will increase the transformation amounts of both phase zones $\alpha$ and $\gamma$ in normalizing treatment, significantly reduce the phase transformation point temperature Acl, cause the abnormal refinement of crystal structure and thus increase iron loss. In addition, if the content of C as an interstitial element is too high, it will be disadvantageous for the improvement of the fatigue property of silicon steel. If C content is too high, it will cause magnetic failure; if C content is too low, it will significantly reduce the yield strength. In the present invention, C content is limited to 0.001~0.004 wt %.

N: it is easy for N as an interstitial element to form fine dispersed nitrides with Ti, Al, Nb or V, which intensively hinders the growth of grains and deteriorates iron loss. If N content is too high, the amount of nitride precipitates increases, which intensively hinders the growth of grains and deteriorates iron loss. In the present invention, N content is limited to be 0.003 wt % or less.

Figure 3:
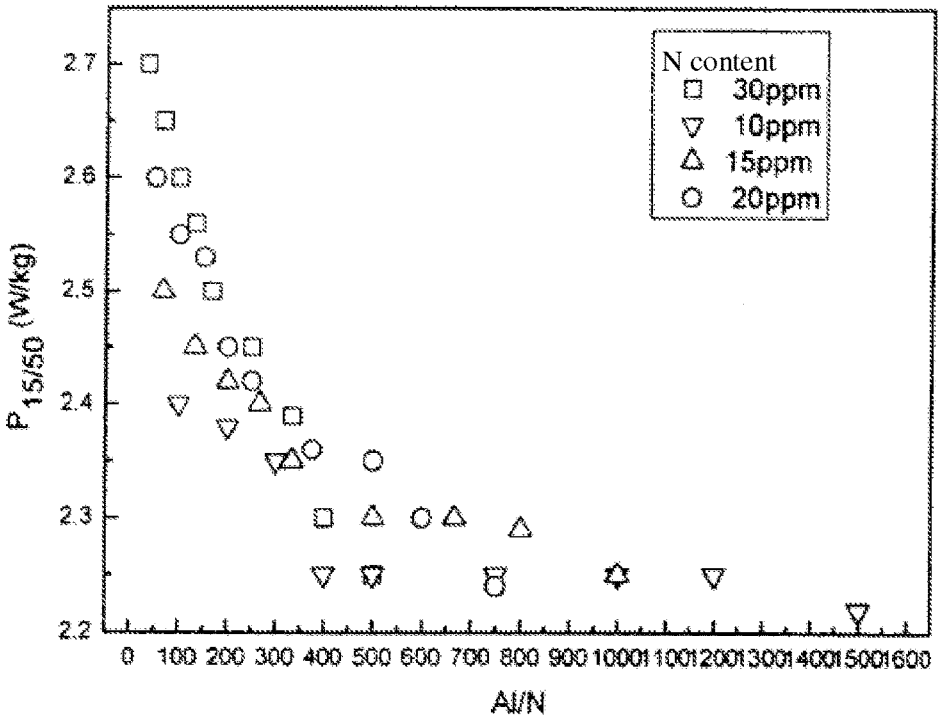
FIG. 3 shows the relationship between the Al/N ratio of the casting slab for manufacturing the non-oriented silicon steel and the iron loss P15/50 of the non-oriented silicon steel.

Usually, Al content is increased to form coarsened AlN and reduce the influence of N element and other fine nitride. The Al/N ratio will directly influence the form and size of AlN. If Al content is too low, fine needle-like AlN will be formed, which seriously influences the magnetic domain motion and thus deteriorates iron loss. The present inventor has investigated the relationship between the Al/N ratio and the iron loss $P_{15/50}$ of the non-oriented silicon steel. FIG. 3 shows the relationship between the Al/N ratio of the casting slab for manufacturing the non-oriented silicon steel and the iron loss $P_{15/50}$ of the non-oriented silicon steel. As shown in FIG. 3, the iron loss is low when the Al/N ratio is 300 or more and preferably between 350 and 600, and that the effect of reducing iron loss becomes basically saturation when the Al/N ratio reaches 600. In the present invention, the Al/N ratio is limited to be 300 or more, and preferably between 350 and 600.

O: it is harmful for the magnetic property and is able to form oxide inclusions during the steel making process, its amount and form significantly influence the magnetic property. Thus, in addition to reducing the final oxygen content in the steel making process as far as possible, it is also needed to reduce the amount of oxides and control their form through steel making techniques.

B: When B is added in the steel with low Si content, it can reduce Al content and lower the steel making cost; when B is added in the steel with high Si content and Al content, it is in the solid solution state, and in this state, it can improve the crystal structure by its segregation along grain boundary while preventing embrittlement caused by P segregation and preventing the formation of internal oxide layer and internal nitride layer, thus promoting the growth of grains. However, as an interstitial atom, excessive B content will hinder the magnetic domain motion and reduce the magnetic property. Therefore, in the present invention, B content is limited to be 0.005 wt % or less.

Next, the present inventor has investigated the influence of both the total amount of nitrogen and oxygen in the surface layer and the equivalent axial coefficient of the grains of the non-oriented silicon steel on the iron loss and/or the anisotropy of iron loss of the non-oriented silicon steel.

Figure 4:
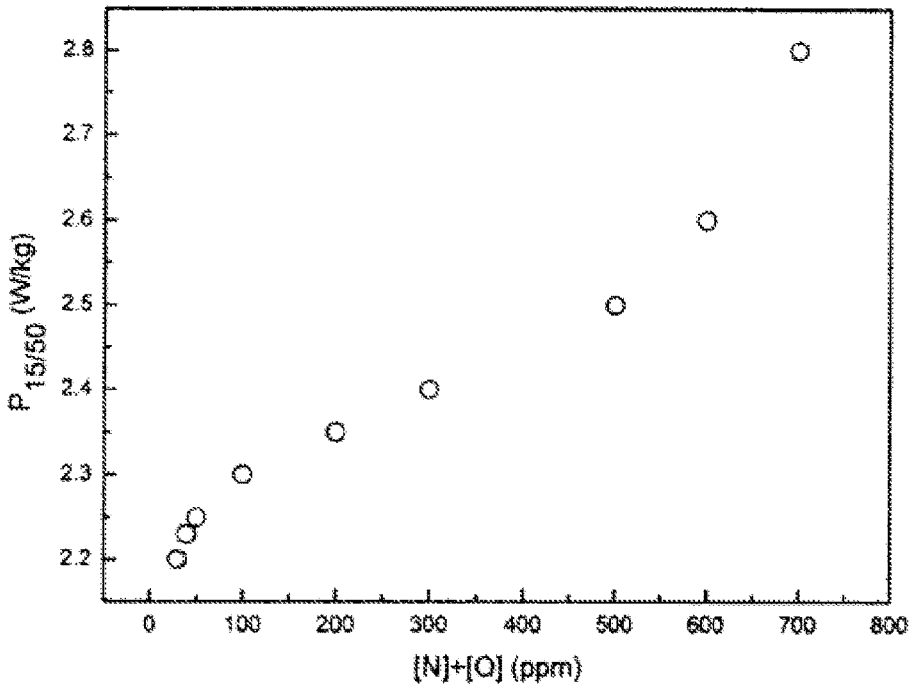
FIG. 4 shows the relationship between the total content of nitrogen and oxygen at a depth of 30 μm from the surface of the non-oriented silicon steel and the iron loss P15/50 of the non-oriented silicon steel.

The total content of nitrogen and oxygen in the surface layer of the non-oriented silicon steel represents the degree of surface nitridation and internal oxidation and the total amount level of oxides, which directly influences the iron loss level of the non-oriented silicon steel. FIG. 4 shows the relationship between the total content of nitrogen and oxygen at a depth of 30 μm from the surface of the non-oriented silicon steel and the iron loss $P_{15/50}$ of the non-oriented silicon steel. As shown in FIG. 4, the iron loss of the non-oriented silicon steel increases with the increase of the total content of nitrogen and oxygen, and the non-oriented silicon steel presents a low iron loss when the total content of nitrogen and oxygen is 300 ppm or less. Therefore, in order to obtain the non-oriented silicon steel having a low iron loss, the total content of nitrogen and oxygen in the surface layer of the non-oriented silicon steel should be reduced as far as possible.

Said "equivalent axial coefficient of the grains" in the present invention is defined as follows: selecting samples in parallel to the sheet surface, rubbing off the surface layer to make the metallographic samples, observing the grain structure under a microscope, and respectively measuring the average diameter $D_L$ of the grain structure parallel to the rolling direction and the average diameter $D_C$ of the grain structure perpendicular to the rolling direction (i.e., cross direction). The ratio of the average diameter $D_L$ to the average diameter $D_C$ is defined as equivalent axial coefficient L of the grains, i.e., $L=D_L/D_C$.

Figure 5:
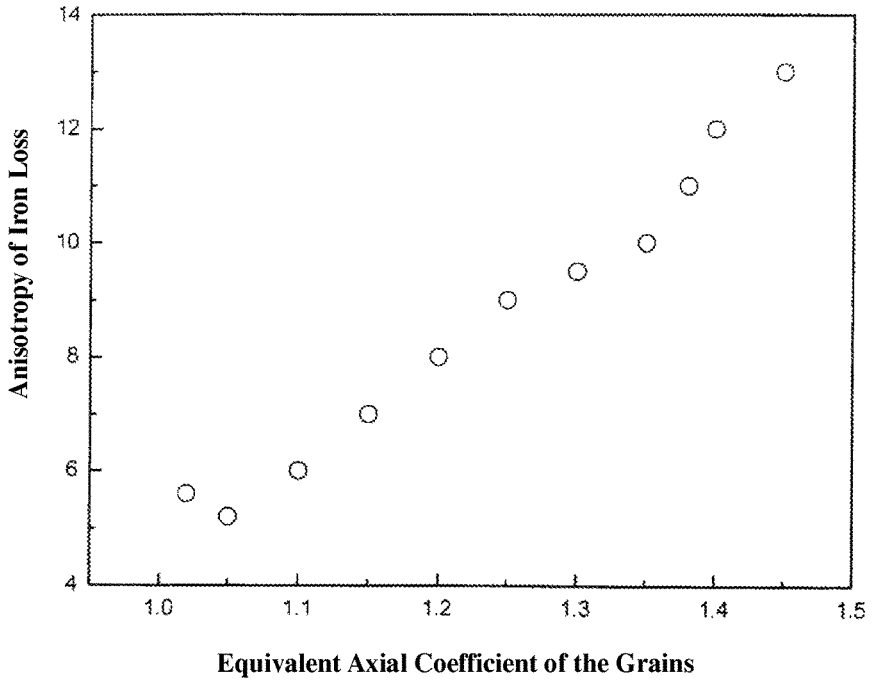
FIG. 5 shows the relationship between the equivalent axial coefficient of the grains of the non-oriented silicon steel and anisotropy of iron loss of the non-oriented silicon steel.

L is employed to characterize the shape features of the grains in the rolling direction and cross direction. When the L value is more approximate to 1, it means that the grains are more approximate to equivalent axial grains; when the L value is more deviated from 1, it means that the grains are more deviated from the equivalent axial form; the higher the L value is, the longer the grains in the rolling direction are, and the shorter the grains in the cross direction are. FIG. 5 shows the relationship between the equivalent axial coefficient of the grains of the non-oriented silicon steel and anisotropy of iron loss of the non-oriented silicon steel. As shown in FIG. 5, the non-oriented silicon steel has a low anisotropy of iron loss when the L value falls between 1.05 and 1.35. Therefore, in order to obtain the non-oriented silicon steel having an excellent magnetic property, preferably the equivalent axial coefficient L of the grains is set between 1.05 and 1.35.

In one preferable embodiment in the method of the present invention, in RH refining, deoxidation is implemented first by using FeSi alloy and then by using FeAl alloy. Firstly using FeSi alloy for deoxidation can effectively eliminate most of the free oxygen contained in the silicon steel, and the resulted deoxidized product $SiO_2$ has large size and is easy to come up and be eliminated; then using FeAl alloy having a deoxidizing capacity better than FeSi alloy can easily eliminate the residual free oxygen in the silicon steel, significantly reduce the amount of oxide inclusions of the silicon steel, control the amount of oxide inclusions having a size of 500 nm or less contained in the final silicon steel products to be 40% or less, and thus weaken the pining effect of grain boundary and the pining effect of magnetic domain and improve the magnetic property of the silicon steel. The influence of FeSi alloy deoxidation and FeAl alloy deoxidation on the inclusions of the silicon steel is shown in Table 1.

TABLE 1

| | <0.5 μm | 0.5~1 μm | 1~1.5 μm | 1.5~5 μm | 5~10 μm |
|---|---|---|---|---|---|
| FeSi alloy deoxidation | A large amount of MnS, $Cu_2S$ and AlN | AlN and MnS complex, some MnS | AlN and MnS complex, some $Cu_2S$ | AlN and MnS complex, a small amount of CaO, $Al_2O_3$, FeO and other complex | A small amount of FeO and $SiO_2$ complex |
| FeAl alloy deoxidation | A large amount of MnS and $Cu_2S$ | Mainly MgO + MnS/$Cu_2S$ | Mainly AlN and $Al_2O_3$ | AlN, $Al_2O_3$ and $SiO_2$ or $Cu_2S$ complex | A small amount of FeO and $Al_2O_3$ complex |

In another preferable embodiment in the method of the present invention, in said hot rolling step b), a deformation at 950° C. or more is 80% or more. The influence of the high-temperature deformation in hot rolling (deformation at 950° C. or more) on steel strip structure is shown in Table 2. As shown in table 2, increasing the high-temperature deformation in hot rolling can reduce the fine precipitates in the steel strip and improve the recrystallization of grains. Therefore, in order to obtain the non-oriented silicon steel having an excellent magnetic property, in the method of the present invention, preferably in said hot rolling step b), a deformation at 950° C. or more is 80% or more.

TABLE 2

| | Deformation at 950° C. or more | Fine precipitates | Recrystallization |
|---|---|---|---|
| 1 | 30% | Obviously visible | Fiber structure at the core |
| 2 | 50% | Obviously visible | Fiber structure at the core |
| 3 | 60% | Visible | A small amount of Fiber structure at the core |
| 4 | 80% | Extremely few | Fully recrystallized |
| 5 | 85% | Extremely few | Fully recrystallized |

In another preferable embodiment in the method of the present invention, the maximum temperature difference between various positions of the hot-rolled steel strip in the hot rolling step is preferably 20° C. or less, and further preferably 10° C. or less. The relationship between the maximum center-edge temperature difference of the steel strip and the maximum degree of convexity and edge crack is shown in Table 3. As shown in table 3, both the degree of convexity and the edge crack reached an excellent level when the temperature difference is 20° C. or less, and edge crack can be mostly avoided when the temperature difference is 10° C. or less. Therefore, in view of obtaining excellent sheet shape and preventing edge crack, the maximum temperature difference between various positions of the hot-rolled steel strip is preferably 20° C. or less, and further preferably 10° C. or less.

TABLE 3

| | Maximum center-edge temperature difference (° C.) | Maximum degree of convexity | Edge crack |
|---|---|---|---|
| 1 | 10 | 30 μm | No edge crack |
| 2 | 15 | 30 μm | Occasional edge crack |
| 3 | 20 | 35 μm | Slight edge crack |
| 4 | 30 | 50 μm | Edge crack |
| 5 | >35 | 60 μm | Obvious edge crack |

Next, the present invention will be further described in conjunction with examples, but the protection scope of the present invention is not limited to these examples.

Example 1

In the first steel making step, a casting slab containing the following ingredients as calculated by weight percentage is obtained through RH refining and continuous casting: C 0.002%, Si 3.2%, Al 0.7%, Mn 0.50%, P 0.014%, S 0.001%, N 0.002%, B 0.002%, Nb 0.001%, V 0.002%, Ti 0.0015%, Zr 0.001%, Sn 0.008%, and the balance being Fe and unavoidable impurities; in the steel making step, the temperature T of molten steel during tapping on converter, the carbon content [C] and the free oxygen content [O] satisfy the following formula: $7.27\times10^3 \leq [O][C]e^{(-5,000/T)} \leq 2.99\times10^4$, and, in RH refining, deoxidation is implemented first by using FeSi alloy and then by using FeAl alloy.

In the following hot rolling step, the casting slab is heated to 1,100° C. and is rolled after thermal insulation, and the temperature at the end of hot rolling is 850° C. or more, wherein the deformation at 950° C. or more is 80% or more and the hot-rolled steel strip has a thickness of 1.5-3.0 mm.

Then, the continuous annealing of normalization or batch furnace of normalization is adopted. When the continuous annealing of normalization is adopted, the normalization process is maintained for 10~90 s at 850~950° C., the heating rate of normalization is 5~15° C./s, and the cooling rate is 5~20° C./s; when the batch furnace of normalization is adopted, the normalization process is maintained for 2~6 h at 780~880° C. under the protection atmosphere of hydrogen.

Next, the hot-rolled steel strip after normalizing treatment is subject to cold rolling to form the cold-rolled steel strip, and the cold-rolled steel strip has a thickness of 0.27~0 5 mm after cold rolling, and the reduction rate of cold rolling is 70~88%.

Finally, the cold-rolled steel strip is subject to annealing. In the continuous annealing furnace, it is heated to 900° C. at the heating rate of 25~45° C./s, and at such temperature, the annealing process is maintained for 8~60 s under the protection atmosphere of nitrogen and hydrogen and under the tension б of 0.5 MPa, thus to obtain the non-oriented silicon steel in Example 1.

Example 2

Non-oriented silicon steel in Example 2 is produced with the same method as that used in Example 1, except that the annealing temperature in the final annealing step is changed to 920° C.

Example 3

Non-oriented silicon steel in Example 3 is produced with the same method as that used in Example 1, except that the annealing temperature in the final annealing step is changed to 1,020° C.

Example 4

Non-oriented silicon steel in Example 4 is produced with the same method as that used in Example 1, except that the annealing temperature in the final annealing step is changed to 1,050° C.

Example 5

Non-oriented silicon steel in Example 5 is produced in the same method as that used in Example 1, except that the tension б in the final annealing step is changed to 1 MPa.

Example 6

Non-oriented silicon steel in Example 6 is produced with the same method as that used in Example 1, except that the tension б in the final annealing step is changed to 1.3 MPa.

Example 7

Non-oriented silicon steel in Example 7 is produced with the same method as that used in Example 1, except that the tension б in the final annealing step is changed to 1.5 MPa.

Comparative Example 1

Non-oriented silicon steel in Comparative Example 1 is produced with the same method as that used in Example 1, except that the annealing temperature in the final annealing step is changed to 850° C.

Comparative Example 2

Non-oriented silicon steel in Comparative Example 2 is produced with the same method as that used in Example 1, except that the annealing temperature in the final annealing step is changed to 1,100° C.

Comparative Example 3

Non-oriented silicon steel in Comparative Example 3 is produced with the same method as that used in Example 1, except that the tension б in the final annealing step is changed to 0.3 MPa.

Comparative Example 4

Non-oriented silicon steel in Comparative Example 4 is produced with the same method as that used in Example 1, except that the tension б in the final annealing step is changed to 2 MPa.

Comparative Example 5

Non-oriented silicon steel in Comparative Example 5 is produced with the same method as that used in Example 1, except that the annealing time in the final annealing step is changed to 5 s.

Comparative Example 6

Non-oriented silicon steel in Comparative Example 6 is produced with the same method as that used in Example 1, except that the temperature T of molten steel during tapping on converter in steel making, the carbon content [C] and the free oxygen content [O] fail to satisfy the following formula: $7.27\times10^3 \leq [O][C]e^{(-5,000/T)} \leq 2.99\times10^4$.

The iron loss $P_{15/50}$ and the anisotropy of iron loss of non-oriented silicon steel (0.5 mm in thickness) in the above examples and comparative examples are measured, and the results are shown in Table 4.

TABLE 4

| | Whether satisfying the following formula: $7.27 \times 10^3 \leq [O][C]e^{(-5,000/T)} \leq 2.99 \times 10^4$ | Temperature in the final annealing (° C.) | Tension σ in the final annealing (MPa) | Annealing time in the final annealing (s) | Iron loss $P_{15/50}$ (W/kg) | Anisotropy of iron loss (%) |
|---|---|---|---|---|---|---|
| Example 1 | Yes | 900 | 0.5 | 8~60 | 2.37 | 7.5 |
| Example 2 | Yes | 920 | 0.5 | 8~60 | 2.35 | 8.0 |
| Example 3 | Yes | 1,020 | 0.5 | 8~60 | 2.30 | 9.0 |
| Example 4 | Yes | 1,050 | 0.5 | 8~60 | 2.26 | 9.6 |
| Example 5 | Yes | 900 | 1 | 8~60 | 2.34 | 8.6 |
| Example 6 | Yes | 900 | 1.3 | 8~60 | 2.28 | 9.1 |
| Example 7 | Yes | 900 | 1.5 | 8~60 | 2.30 | 9.5 |
| Comparative Example 1 | Yes | 850 | 0.5 | 8~60 | 2.45 | 7.0 |
| Comparative Example 2 | Yes | 1,100 | 0.5 | 8~60 | 2.26 | 11.1 |
| Comparative Example 3 | Yes | 900 | 0.3 | 8~60 | 2.53 | 7.0 |
| Comparative Example 4 | Yes | 900 | 2 | 8~60 | 2.46 | 10.1 |
| Comparative Example 5 | Yes | 900 | 0.5 | 5 | 2.65 | 7.2 |
| Comparative Example 6 | No | 900 | 0.5 | 8~60 | 2.48 | 8.0 |

It can be known from the above table, compared with the comparative examples, the non-oriented silicon steel in the above examples has a low iron loss and low anisotropy of iron loss. The non-oriented silicon steel has an iron loss $P_{15/50}$ of 2.40 W/kg or less and anisotropy of iron loss of 10% or less at 0.5 mm thickness, wherein $P_{15/50}$ represents the iron loss of the non-oriented silicon steel under a magnetic induction of 1.5 T at 50 Hz.

In addition, the present inventor has measured the surface property and grain property of the non-oriented silicon steel in the above examples. The results show that the non-oriented silicon steel in the above examples has a grain diameter between 100 and 200 nm, and the grain equivalent axial coefficient L between 1.05 and 1.35. Furthermore, the total content of nitrogen and oxygen at a depth of 30 nm from the surface of the non-oriented silicon steel in the above examples is 300 ppm or less, and the amount of inclusions having a size of 500 nm or less contained in the non-oriented silicon steel is 40% or less.

The experimental results of the present invention demonstrate that, in the present invention, by strictly controlling the relationship among the temperature T of molten steel during tapping on converter and the carbon content [C] and free oxygen content [O] and regulating the content of various ingredients in the casting slab, both the total content of nitrogen and oxygen and the amount of inclusions in the non-oriented silicon steel can be reduced, thus improve the structure and magnetic properties of the non-oriented silicon steel. Furthermore, by making low-temperature short-term annealing at the temperature of 900~1,050° C. and under the tension of 0.5~1.5 MPa, the grains can rapidly grow and obtain a suitable grain equivalent axial coefficient, and thus reduce both the iron loss and the anisotropy of iron loss and increase the magnetic property of the non-oriented silicon steel.

BENEFICIAL EFFECTS OF THE PRESENT INVENTION

By means of regulating the content of various ingredients in the casting slab through steel making, strictly controlling the relationship among the temperature T of molten steel during tapping on converter and the carbon content [C] and free oxygen content [O] to reduce the amount of inclusions and control their form, making low-temperature short-term annealing at a tension to control the form of grains, the present invention can obtain non-oriented silicon steel having excellent iron loss and anisotropy of iron loss. The non-oriented silicon steel in the present invention can satisfy the miniaturization and energy conservation requirements of electronic equipment, thus have a broad application prospect.

What is claimed is:

1. A method for producing non-oriented silicon steel, the method comprising the following steps in sequence: a) steel making, b) hot rolling, c) normalizing, d) cold rolling, and e) annealing, wherein, a casting slab containing the following composition by weight percentage is obtained by said steel making step a): C 0.001~0.004%, Si 2.5~4.0%, Al 0.5~1.5%, Mn 0.10~1.50%, P≤0.02%, S≤0.002%, N≤0.003%, B≤0.005%, where Mn/S≥300, Al/N≥300, and the balance being Fe and unavoidable impurities, wherein, said steel making step a) includes converter steel making, in which the temperature T of molten steel during tapping on converter, the carbon content [C] and the free oxygen content [O] satisfy the following formula:

$$7.27\times10^3 \leq [O][C]e^{(-5,000/T)} \leq 2.99\times10^4,$$

wherein said steel making step a) further includes a step of RH refining, and in said RH refining, a deoxidation is implemented at the end of decarbonization first by using FeSi alloy and then by using FeAl alloy, in sequence;

in said annealing step e), the cold-rolled steel strip is heated to 900~1,050° C., and then is subject to thermal insulation under a tension б of 0.5~1.5 MPa for a period of time t of 8~60 sec;

wherein said casting slab contains Sn and Sb, the content of Sb+2Sn ranging between 0.001~0.05 wt %; and wherein further, the non-oriented silicon steel so produced comprises a grain diameter between 100 and 200 μm, a grain equivalent axial coefficient L between 1.05 and 1.35, an iron loss P15/50≤2.40 W/kg, and an anisotropy of iron loss ≤10%.

2. The method for producing non-oriented silicon steel according to claim 1, wherein in said annealing step e), the temperature is 920~1,000° C. and the tension б is 1~1.3 MPa.

3. The method for producing non-oriented silicon steel according to claim 1, wherein the casting slab obtained in said steel making step a) satisfies: 350≤(Mn/S)≤600, 350≤(Al/N)≤600.

4. The method for producing non-oriented silicon steel according to claim 1, wherein said cold rolling step d) has a reduction rate of 70~88%.

5. The method for producing non-oriented silicon steel according to claim 1, wherein a batch furnace of normalization is used in said normalizing step c) where the steel strip is subject to a thermal insulation at 780~880° C. for 2~6 hours under a protection atmosphere of nitrogen and hydrogen.

6. The method for producing non-oriented silicon steel according to claim 1, wherein a continuous annealing of normalization is used in said normalizing step c) where the hot-rolled steel strip is firstly heated to 850~950° C. at a heating rate of 5~15° C./sec, and is subject to a thermal insulation under a protection atmosphere of nitrogen for a period of time t of 10~90 sec, then is cooled to 650° C. at a cooling rate of 10° C./sec or less, and is finally left for natural cooling.

7. The method for producing non-oriented silicon steel according to claim 6, wherein, in said normalizing step c), the hot-rolled steel strip is heated to 850~930° C.

8. The method for producing non-oriented silicon steel according to claim 1, wherein said hot rolling step b) has a deformation of 80% or more at 950° C. or more.

9. The method for producing non-oriented silicon steel according to claim 8, wherein in said hot rolling step b), the maximum temperature difference between various positions of the hot-rolled steel strip is 20° C. or less.

* * * * *